US011368807B2

(12) United States Patent
Laaksonen et al.

(10) Patent No.: US 11,368,807 B2
(45) Date of Patent: Jun. 21, 2022

(54) PREVIEWING SPATIAL AUDIO SCENES COMPRISING MULTIPLE SOUND SOURCES

(71) Applicant: Nokia Technologies Oy, Espoo (FI)

(72) Inventors: Lasse Laaksonen, Tampere (FI); Miikka Vilermo, Siuro (FI); Arto Lehtiniemi, Lempäälä (FI); Sujeet Shyamsundar Mate, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 17/049,445

(22) PCT Filed: May 10, 2019

(86) PCT No.: PCT/EP2019/062033
§ 371 (c)(1),
(2) Date: Oct. 21, 2020

(87) PCT Pub. No.: WO2019/219527
PCT Pub. Date: Nov. 21, 2019

(65) Prior Publication Data

US 2021/0250720 A1 Aug. 12, 2021

(30) Foreign Application Priority Data

May 14, 2018 (EP) ..... 18171975

(51) Int. Cl.
*H04S 7/00* (2006.01)
*H04S 3/00* (2006.01)

(52) U.S. Cl.
CPC ..... *H04S 7/303* (2013.01); *H04S 3/002* (2013.01); *H04S 3/008* (2013.01); *H04S 2400/01* (2013.01); *H04S 2400/11* (2013.01)

(58) Field of Classification Search
None
See application file for complete search history.

(56) References Cited

U.S. PATENT DOCUMENTS

2002/0141597 A1 10/2002 Wilcock
2012/0263308 A1* 10/2012 Herre ..... G10L 19/008 381/22

(Continued)

FOREIGN PATENT DOCUMENTS

EP 3236363 A1 10/2017
EP 3422148 A1 1/2019

(Continued)

OTHER PUBLICATIONS

Extended European Search Report received for corresponding European Patent Application No. 18171975.8, dated Oct. 29, 2018, 8 pages.

(Continued)

*Primary Examiner* — Qin Zhu
(74) *Attorney, Agent, or Firm* — Alston & Bird LLP

(57) ABSTRACT

An apparatus comprising means for: in response to user input, selecting at least one sound source of a spatial audio scene, comprising multiple sound sources, the spatial audio scene being defined by spatial audio content; selecting at least one related contextual sound source based on the at least one selected sound source; and causing rendering of an audio preview, representing the spatial audio content, that can be selected by a user, wherein the audio preview comprises a mix of sound sources including at least the at least one selected sound source and the at least one related contextual sound source but not all of the multiple sound sources of the spatial audio scene, and wherein selection of the audio preview causes an operation on at least the selected sound source.

20 Claims, 3 Drawing Sheets

(56) References Cited

U.S. PATENT DOCUMENTS

| | | | | |
|---|---|---|---|---|
| 2015/0055770 | A1* | 2/2015 | Spittle | H04S 7/302 379/202.01 |
| 2016/0080684 | A1* | 3/2016 | Farrell | H04N 9/8211 386/227 |
| 2016/0255453 | A1* | 9/2016 | Fueg | H04S 7/30 381/1 |
| 2017/0309289 | A1 | 10/2017 | Eronen et al. | |
| 2018/0124543 | A1 | 5/2018 | Leppanen et al. | |
| 2019/0045315 | A1* | 2/2019 | Dickins | G06F 3/017 |

FOREIGN PATENT DOCUMENTS

| | | | |
|---|---|---|---|
| JP | 2008-092193 | A | 4/2008 |
| WO | 2018/134475 | A1 | 7/2018 |

OTHER PUBLICATIONS

International Search Report and Written Opinion received for corresponding Patent Cooperation Treaty Application No. PCT/EP2019/062033, dated Jul. 24, 2019, 14 pages.
Office action received for corresponding European Patent Application No. 18171975.8, dated Oct. 20, 2020, 7 pages.
Office Action for Japanese Application No. 2020-561918 dated Jan. 24, 2022, 8 pages.
Summons to Attend Oral Proceedings for European Application No. 18171975.8 dated Dec. 22, 2021, 8 pages.

* cited by examiner

PREVIEWING SPATIAL AUDIO SCENES COMPRISING MULTIPLE SOUND SOURCES

RELATED APPLICATION

This application claims priority to PCT Application No. PCT/EP2019/062033, filed on May 10, 2019 which claims priority to EP Application No. 18171975.8, filed on May 14, 2018, each of which is incorporated herein by reference in its entirety.

TECHNOLOGICAL FIELD

Embodiments of the present disclosure relate to previewing spatial audio scenes comprising multiple sound sources.

BACKGROUND

Multiple loudspeakers can be used to render spatial audio content so that a listener perceives the rendered spatial audio as emanating from one or more virtual sources at one or more particular locations or bearings.

An audio scene is a representation of a sound space (a sound field created by an arrangement of sound sources in a space) as if listened to from a particular point of view within the sound space. The point of view may be variable, for example, determined by an orientation of a virtual user and also possibly a location of a virtual user.

In a standard stereo audio track, for example a musical piece on a Compact Disk (CD) album, content rendered to a listener has been controlled by the content creator. The listener is passive and cannot change his or her point of view. If a user wishes to find a particular scene then the search is constrained to a search through time.

For spatial audio, content rendered to a listener is controlled by the variable view point of the virtual user. If a user wishes to find a particular scene then the search is a search through both space and time.

BRIEF SUMMARY

According to various, but not necessarily all, embodiments there is provided an apparatus comprising means for:

in response to user input, selecting at least one sound source of a spatial audio scene, comprising multiple sound sources, the spatial audio scene being defined by spatial audio content;

selecting at least one related contextual sound source based on the at least one selected sound source; and causing rendering of an audio preview, representing the spatial audio content, that can be selected by a user, wherein the audio preview comprises a mix of sound sources including at least the at least one selected sound source and the at least one related contextual sound source but not all of the multiple sound sources of the spatial audio scene, and wherein selection of the audio preview causes an operation on at least the selected sound source.

According to various, but not necessarily all, examples the operation caused by selection of the audio preview comprises:

causing spatial rendering of the spatial audio scene, comprising multiple sound sources including the selected sound source and the at least one related contextual sound source, the spatial audio scene being defined by spatial audio content.

According to various, but not necessarily all, examples the apparatus comprises means for causing, before the user input; spatial rendering of a first spatial audio scene, comprising multiple first sound sources, defined by first spatial audio content wherein the user input is selection of at least one first sound source rendered in the first spatial audio scene.

According to various, but not necessarily all, examples selecting at least one sound source of a spatial audio scene, comprising multiple sound sources, defined by spatial audio content comprises selecting at least one first sound source of the first spatial audio scene, comprising multiple first sound sources, defined by first spatial audio content, wherein selecting at least one related contextual sound source based on the at least one selected sound source comprises selecting at least one related contextual sound source based on the at least one selected first sound source, wherein causing rendering of an audio preview, representing the spatial audio content, that can be selected by a user comprises causing rendering of an audio preview, representing the first spatial audio content, that can be selected by a user wherein the audio preview comprises a mix of sound sources including at least the at least one selected first sound source and the at least one related contextual sound source but not all of the multiple first sound sources of the first spatial audio scene wherein selection of the audio preview causes an operation on at least the selected first sound source and the at least one related first contextual sound source.

According to various, but not necessarily all, examples the user input is specifying a search.

According to various, but not necessarily all, examples selecting at least one sound source of a spatial audio scene, comprising multiple sound sources, defined by spatial audio content comprises selecting at least one second sound source of a second new spatial audio scene, comprising multiple second sound sources, defined by second spatial audio content, wherein selecting at least one related contextual sound source based on the at least one selected sound source comprises selecting at least one related contextual sound source based on the at least one selected second sound source, wherein causing rendering of an audio preview, representing the spatial audio content, that can be selected by a user comprises causing rendering of an audio preview, representing the second spatial audio content, that can be selected by a user wherein the audio preview comprises a mix of sound sources including at least the at least one selected second sound source and the at least one related contextual sound source but not all of the multiple second sound sources of the second spatial audio scene wherein selection of the audio preview causes an operation on at least the selected second sound source According to various, but not necessarily all, examples the means are configured to:

in response to selection by a user of the rendered audio preview, representing the spatial audio content, cause spatial rendering of the spatial audio scene defined by the spatial audio content including rendering of the multiple sound sources;

determine a virtual user position comprising a location and an orientation, associated with the spatial audio scene; and enable a user to change the rendered spatial audio scene from the spatial audio scene by changing the position of the virtual user, the position of the virtual user being dependent on a changing orientation of the user or a changing a location and orientation of the user.

According to various, but not necessarily all, examples the means is configured to select the at least one related contextual sound source, from amongst the multiple sound sources, based on the at least one selected sound source.

According to various, but not necessarily all, examples the means are configured to:

logically separate the multiple sound sources into major sound sources and minor sound sources based on spatial and/or audio characteristics, wherein the at least one selected sound source is selected from a group comprising the major sound sources and wherein the at least one related contextual sound source is selected from a group comprising the minor sound sources.

According to various, but not necessarily all, examples the means are configured to: select the at least one related contextual sound source, from amongst the multiple sound sources, based on the at least one selected sound source and upon (i) metadata provided as an original part of the spatial audio content by a creator of the spatial audio content; and/or (ii) a metric dependent upon loudness of the multiple sound sources; and/or (iii) a metric dependent upon one or more defined ontologies between the multiple sound sources.

According to various, but not necessarily all, examples the means are configured to:

select the at least one related contextual sound source, from amongst a sub-set of the multiple sound sources, based on the at least one selected sound source, wherein the sub-set of the multiple sound sources comprises sound sources that are the same irrespective of orientation of the user and does not comprise sound sources that vary with orientation of the user, and/or select the at least one related contextual sound source, from amongst a sub-set of the multiple sound sources, based on the at least one selected sound source, wherein the sub-set of the multiple sound sources comprises sound sources dependent upon the user.

According to various, but not necessarily all, examples the means are configured to: cause rendering of multiple audio previews, representing different respective spatial audio content, that can be selected by a user to cause spatial rendering of different respective spatial audio scenes, comprising different respective multiple sound sources, defined by the different respective spatial audio content, wherein an audio preview comprises a mix of sound sources including at least one user-selected sound source and at least one context-selected sound source, dependent upon the at least one selected sound source, but not including all of the respective multiple sound sources of the respective spatial audio scene; and enable the user to browse the multiple audio previews without selecting an audio preview; enable the user to browse the multiple audio previews to a desired audio preview and to select the desired audio preview; and in response to selection by a user of a rendered audio preview, cause spatial rendering of the spatial audio scene defined by the selected spatial audio content including rendering of the multiple sound sources comprised in the selected spatial audio content.

According to various, but not necessarily all, embodiments there is provided a method comprising:

in response to user input, selecting at least one sound source of a spatial audio scene defined by spatial audio content and comprising multiple sound sources;

selecting at least one related contextual sound source based on the at least one selected sound source;

causing rendering of an audio preview, representing the spatial audio content, that can be selected by a user, wherein the audio preview comprises a mix of sound sources including at least the selected sound source and the at least one related contextual sound source but not all of the multiple sound sources of the spatial audio scene, wherein selection of the audio preview causes an operation on at least the selected sound source.

According to various, but not necessarily all, examples selecting at least one related contextual sound source comprises selecting the at least one related contextual sound source, from amongst the multiple sound sources, based on the at least one selected sound source and upon (i) metadata provided as an original part of the spatial audio content by a creator of the spatial audio content; and/or (ii) a metric dependent upon loudness of the multiple sound sources; and/or (iii) a metric dependent upon one or more defined ontologies between the multiple sound sources.

According to various, but not necessarily all, embodiments there is provided a computer program comprising instructions for performing at least the following:

in response to user input, selecting at least one sound source of a spatial audio scene defined by spatial audio content and comprising multiple sound sources;

selecting at least one related contextual sound source based on the at least one selected sound source;

causing rendering of an audio preview, representing the spatial audio content, that can be selected by a user, wherein the audio preview comprises a mix of sound sources including at least the selected sound source and the at least one related contextual sound source but not all of the multiple sound sources of the spatial audio scene, wherein selection of the audio preview causes an operation on at least the selected sound source.

According to various, but not necessarily all, embodiments there is provided an apparatus comprising:

at least one processor; and at least one memory including computer program code the at least one memory and the computer program code configured to, with the at least one processor, cause the apparatus at least to perform:

in response to user input, selecting at least one sound source of a spatial audio scene defined by spatial audio content and comprising multiple sound sources;

selecting at least one related contextual sound source based on the at least one selected sound source;

causing rendering of an audio preview, representing the spatial audio content, that can be selected by a user, wherein the audio preview comprises a mix of sound sources including at least the selected sound source and the at least one related contextual sound source but not all of the multiple sound sources of the spatial audio scene, wherein selection of the audio preview causes an operation on at least the selected sound source.

According to various, but not necessarily all, embodiments there is provided a method comprising:

selecting a sound source of a spatial audio scene, comprising multiple sound sources, in response to user input;

selecting a contextual sound source based on the selected sound source;

rendering an audio preview, representing spatial audio content, that can be selected by a user to cause spatial rendering of the spatial audio scene defined by the spatial audio content wherein the audio preview comprises a mix of sound sources including at least the selected sound source and the related contextual sound source but not all of the multiple sound sources of the spatial audio scene.

According to various, but not necessarily all, embodiments there is provided examples as claimed in the appended claims.

BRIEF DESCRIPTION

Some example embodiments will now be described with reference to the accompanying drawings in which.

DETAILED DESCRIPTION

Multiple loudspeakers or head-tracked headphones can be used to render spatial audio content so that a listener perceives the rendered spatial audio as emanating from one or more virtual sources at one or more locations or bearings. The location or bearing may be a location or bearing in three-dimensional space for volumetric or three-dimensional spatial audio, or a location or bearing in a plane for two-dimensional spatial audio.

A sound space is an arrangement of sound sources in a space that creates a sound field. A sound space may be defined in relation to recording sounds (a recorded sound space) and in relation to rendering sounds (a rendered sound space). An audio scene is a representation of the sound space as if listened to from a particular point of view within the sound space. A point of view is determined by an orientation of a virtual user and also possibly a location of a virtual user. A sound object is a sound source that may be located within the sound space irrespective of how it is encoded. It may for example by located by location or by bearing. A recorded sound object represents sounds recorded at a particular microphone or location. A rendered sound object represents sounds rendered as if from a particular location or bearing.

Different formats may be used to encode a spatially varying sound field as spatial audio content. For example, binaural encoding may be used for rendering an audio scene via headphones, a specific type of multi-channel encoding may be used for rendering an audio scene via a correspondingly specific configuration of loudspeakers (for example 5.1 or 7.1 surround sound), directional encoding may be used for rendering at least one sound source at a defined bearing and positional encoding may be used for rendering at least one sound source at a defined location.

In a standard audio track (or movie), content rendered to a listener (or viewer) has been controlled by the content creator. The listener (or viewer) is passive and cannot change his or her point of view. If a user wishes to find a particular scene then the search is only in one dimension-time.

In spatial audio, content rendered to a listener is controlled by the variable view point of the virtual user which can vary in multiple N dimensions, for example two or three dimensions for orientation and two or three dimensions for location. If a user wishes to find a particular scene then the search is in N+1 dimensions—N for space and one for time.

It is possible for the spatial audio scene, including the identity and number of sounds sources rendered, to change with only a small change of value in one of the N+1 dimensions.

In the examples, below an audio preview is used to simplify available content, while still providing context.

Figure 1:
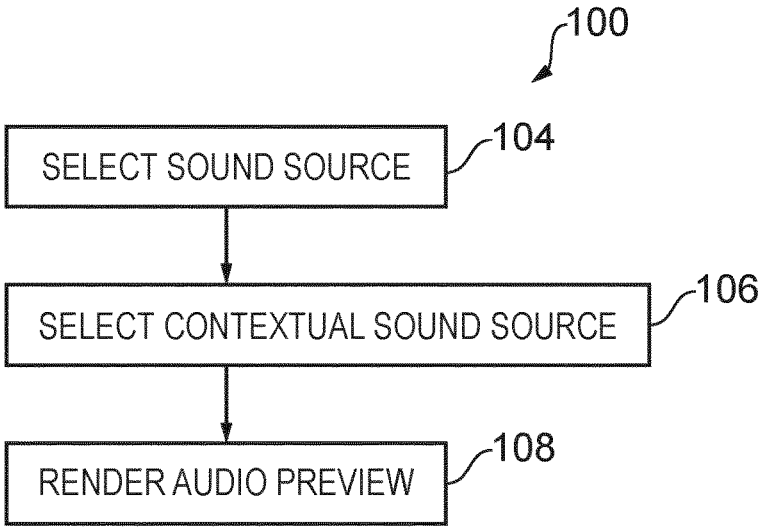
FIG. 1 shows an example embodiment of the subject matter described herein.

FIG. 1 illustrates an example of a method 100. The method 100 is an example of method for previewing spatial audio scenes comprising multiple first sound sources.

The audio preview comprises not only a user-selected sound source of the spatial audio scene being previewed but also at least one additional related contextual sound source that has been selected in dependence on the user-selected sound source. The audio preview does not necessarily comprise all the sound sources of the spatial audio scene being previewed. The audio preview is not merely limited to a single user-selected sound source but is less complex than the spatial audio scene. The audio preview therefore gives a flavor of the complex spatial audio scene without rendering the spatial audio scene.

This has the advantage that a user is presented with relevant information in the audio preview concerning the subject spatial audio scene to make an informed decision of whether or not to select that audio scene for an operation such as, for example, full spatial rendering.

Multiple previews can, for example, be presented to a user either simultaneously or in rapid succession without overwhelming the user.

The method also allows a user to filter spatial audio content to focus on a desired sound source, in context, using the described preview.

The method also allows a user to browse or search spatial audio content to find a desired scene in an efficient manner using the described preview.

FIG. 1 illustrates an example of a method 100 for rendering an audio preview that can be selected by a user.

Figure 4A:
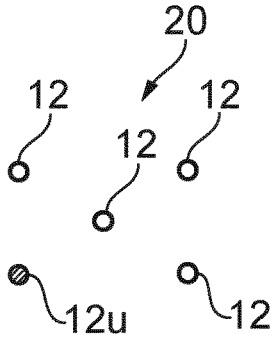
FIGS. 4A to 4C show another example embodiment of the subject matter described herein.
Figure 4B:
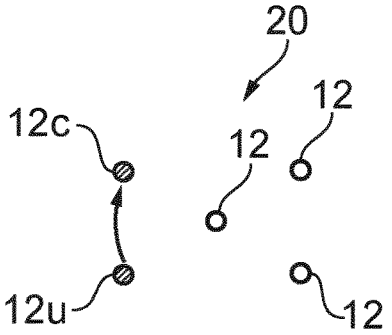
Figure 4C:
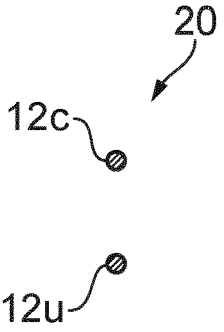

Reference will also be made to FIGS. 4A, 4B and 4C which illustrate the operation of the method 100 with reference to an example of a sound space 10 that comprises sound sources 12.

At block 104, the method 100 comprises, in response to a user input, selecting at least one sound source 12 of a spatial audio scene 20. The spatial audio scene 20 is defined by spatial audio content. The spatial audio scene 20 comprises multiple sound sources 12. FIG. 4A schematically illustrates the selection of at least one sound source $\mathbf{12}_u$ of the spatial audio scene 20 from amongst the multiple sound sources 12.

At block 106, the method 100 comprises selecting at least one related contextual sound source based on the selected sound source $\mathbf{12}_u$. This is schematically illustrated in FIG. 4B, in which the selected sound source $\mathbf{12}_u$ and the related contextual sound source $\mathbf{12}_c$ as well as the relationship between the selected sound source $12_u$ and the related contextual sound source $12_c$ is illustrated. It should be appreciated, that in the example of FIG. 4B, the related contextual sound source $12_c$ is a sound source 12 of the same audio scene 20 that comprises the user-selected sound source $12_u$, however, this is not necessarily the case in all examples. The related contextual sound source $12_c$ may not, for example, be comprised in the audio scene 20 that comprises the user-selected sound source $12_u$.

At block 108, the method 100 comprises causing rendering of an audio preview, representing the spatial audio content. The audio preview can be selected by a user. The audio preview comprises a mix of sound sources including at least the selected sound source $12_u$ and the at least one related contextual sound source $12_c$ but not all of the multiple sound sources 12 of the spatial audio scene 20.

The content of the audio preview is schematically illustrated in FIG. 4C. In this example, the audio preview 22 comprises a mix of sound sources including only the selected sound source $12_u$ and the at least one related contextual sound source $12_c$ and does not comprise any other of the multiple sound sources 12 of the spatial audio scene 20. However, it should be realized that this is merely an example illustration.

The preview can correspond to the original spatial locations of the at least two sound sources or it can be, for example, a monophonic downmix or other spatially reduced rendering. This can depend in some examples at least on any other audio being rendered to the user. For example, it the user is being rendered spatial audio, let's say, on their right-hand side, a spatially reduced preview could be rendered on user's left-hand side. On the other hand, if the user were rendered no other audio, the preview could utilize the whole scene for spatial rendering for the user.

The contextually relevant at least second audio may be from a different spatial location and/or time etc. such that the at least two audios are not simultaneously audible in the regular rendering. Thus, the examples given should not be understood as limiting.

Selection of the audio preview 22 causes an operation on at least the selected sound source $12_u$ and the at least one related contextual sound source. Thus, in the example of FIG. 4C, selection of the audio preview 22 causes an operation on at least the selected sound source $12_u$ and the at least one related contextual sound source $12_c$.

Figure 2:
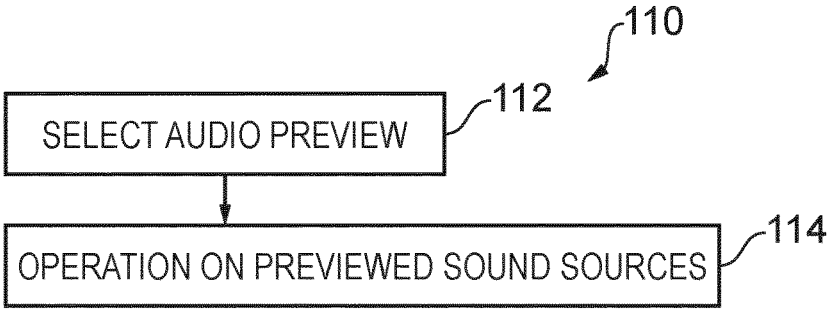
FIG. 2 shows another example embodiment of the subject matter described herein

FIG. 2 illustrates an example of a method 110 for responding to user selection of an audio preview. This method 110 follows on from the method 100 illustrated in FIG. 1.

At block 112, the method 110 comprises selection by a user of the rendered audio preview.

At block 114, the method 110, comprises causing an operation on at least the selected sound source $12_u$ and the at least one related contextual sound source, in response to the user selection at block 112.

It will therefore be appreciated that the user decides what to do with the selected group of sound sources that includes the user-selected sound source $12_u$ and the at least one related contextual sound source $12_c$, represented by the audio preview 22. The user selection of the audio preview causes an operation on this group of sound sources 12.

In some, but not necessarily all, examples, the operation may comprise causing spatial rendering of the spatial audio scene defined by the spatial audio content. This spatial audio scene comprises all of the multiple sound sources 12 including the selected sound source $12_u$ and the at least one related contextual sound source $12_c$.

It will therefore be appreciated that in some examples, the method 100 comprises selecting a sound source $12_u$ of a spatial audio scene 20, comprising multiple sound sources 12, in response to user input; selecting a contextual sound source $12_c$ based on the selected sound source $12u$; and rendering an audio preview 22, representing spatial audio content, that can be selected by a user to cause spatial rendering of the spatial audio scene defined by the spatial audio content wherein the audio preview comprises a mix of sound sources including at least the selected sound source $12_u$ and the related contextual sound source $12_c$.

Figure 5A:
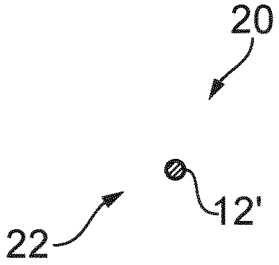
FIGS. 5A and 5B show an example embodiment of the subject matter described herein.
Figure 5B:
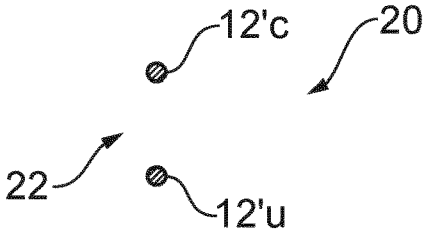

The audio preview 22 may be rendered to the user in different ways, for example, as illustrated in FIGS. 5A and 5B. In FIG. 5A, the user-selected sound source $12_u$ and the at least one related contextual sound source $12_c$ are mixed together to form a monophonic sound source 12' which is rendered to the user as the audio preview 22. In the example of FIG. 5B, the user-selected sound source $12_u$ and the at least one related contextual sound source $12_c$ are rendered as separate sound sources $12'_u$ and $12'_c$ as the audio preview 22.

The user selection of a sound source $12_u$ may occur in different ways as will be described in more detail in the embodiment referred to below. In some, but not necessarily all, embodiments, the selected sound source $12_u$ is selected from a rendered spatial audio scene 20 that comprises the selected sound source $12_u$. In other examples, the selected sound source $12_u$ is selected as a consequence of a user search, where the user input specifies the search. There may or may not be spatial rendering of a spatial audio scene at the time of the search.

Figure 3:
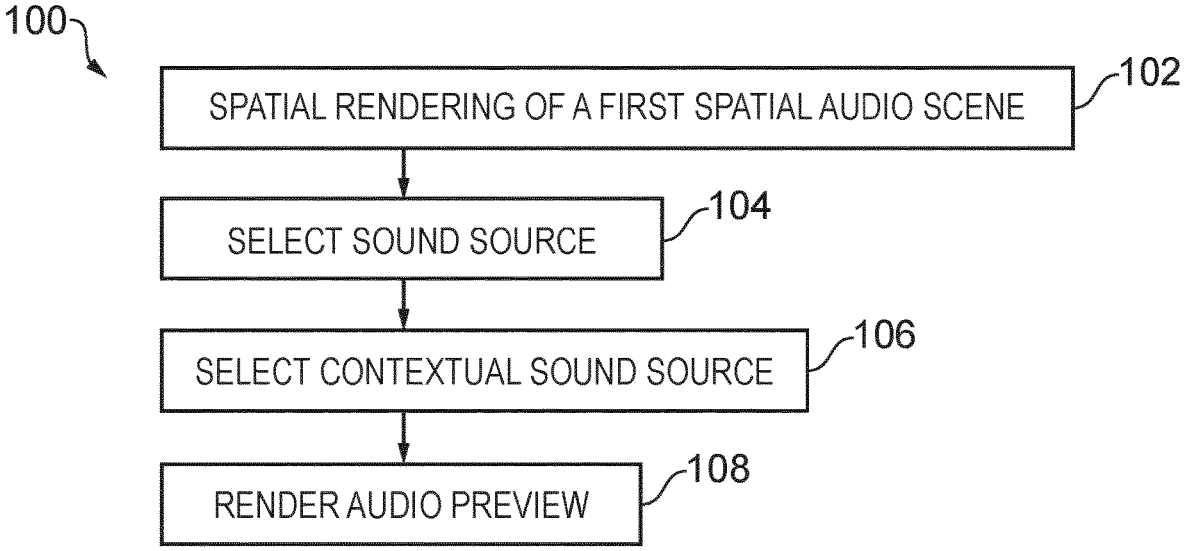
FIG. 3 shows an example embodiment of the subject matter described herein.

FIG. 3 illustrates another example of the method 100 for rendering an audio preview.

At block 102, the method 100 comprises causing spatial rendering of a first spatial audio scene. The first spatial audio scene is defined by first spatial audio content. The first spatial audio scene comprises multiple first sound sources.

At block 104, the method 100 comprises, in response to user input selecting at least one sound source of a second spatial audio scene. The second spatial audio scene is defined by second spatial audio content. The second spatial audio scene comprises multiple second sound sources.

FIG. 4A illustrates an example of the second spatial audio scene 20 comprising multiple second sound sources 12. The selected at least one second sound source $12_u$ is highlighted.

At block 106, the method 100 comprises selecting at least one related contextual sound source $12_c$ based on the at least one selected sound source $12_u$.

In some but not necessarily all examples, the at least one related contextual sound source is one of the multiple second sound sources. However, in other examples this is not the case. FIG. 4B illustrates an example in which the at least one related contextual sound source $12_c$ is one of the multiple second sound sources 12 of the second spatial audio scene 20 that includes the selected second sound source $12_u$.

At block 108, the method 100 comprises causing rendering of an audio preview representing the second spatial audio content. The audio preview can be selected by a user. The audio preview comprises a mix of sound sources including at least the selected sound source $12_u$ and the at least one related contextual sound source $12_c$ but not all of the multiple second sound sources 12 of the second spatial audio scene 20. The selection of the audio preview causes an operation on at least the selected second sound source $12_u$ and the at least one related contextual sound source $12_c$.

The description of the method 110 of FIG. 2 previously given in relation to FIG. 1 is also relevant for this figure. Likewise, the previous description of the operation is also relevant. For example the operation may cause spatial rendering of the second spatial audio scene 20 defined by the second spatial audio content.

FIG. 4C schematically illustrates the sound sources 12 comprised in the audio preview according to one example. In this example, the audio preview comprises a mix of sound sources including only the selected second sound source $\mathbf{12}_u$ and the at least one related contextual sound source, which in this example is a second sound source $\mathbf{12}_c$.

In some but not necessarily all examples, the first spatial audio content may be the same as the second spatial audio content and the first spatial audio scene defined by the first spatial audio content may be the same as the second spatial audio scene defined by the second spatial audio content. Consequently, in this example the first sound sources are the same as the second sound sources. In this example, the audio preview 22 operates as a selective filter focusing on the user-selected sound source $\mathbf{12}_u$ (and its related contextual sound source $\mathbf{12}_c$).

The audio preview 22 does not comprise all of the second sound sources 12 of the second spatial audio scene 20 and therefore serves to focus on or highlight the selected sound source $\mathbf{12}_u$ while still providing context for that sound source $\mathbf{12}_u$.

In other examples, the first and second audio content, the first and second spatial audio scenes and the first and second sound sources are different. Although it is possible for there to be some overlap between the first spatial audio scene and the second spatial audio scene, there will not be complete overlap and the first spatial audio scene and the second spatial audio scene are different. The first and second spatial audio scenes may for example relate to different sound spaces or they may relate to the same sound space for different times and/or different locations and/or different orientations. In this example, the audio preview 22 represents a portal which the user can use to jump to a different orientation and/or a different location and/or a different time and/or to different spatial audio content or different sound space.

Figure 6A:
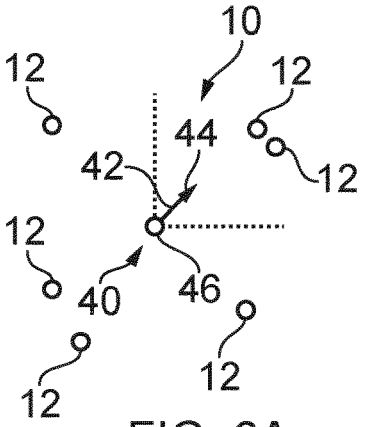
FIGS. 6A to 6F show another example embodiment of the subject matter described herein.

FIG. 6A illustrates an example of a sound space 10 comprising an arrangement of sound sources 12. In some examples, the sound space 10 may extend horizontally up to 360° and may extend vertically up to 180°

Figure 6B:
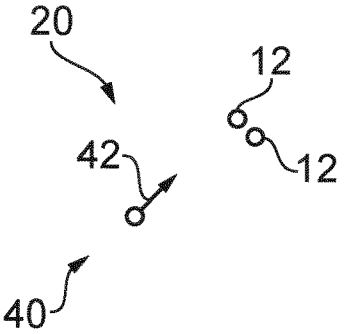

FIG. 6B illustrates an example of a spatial audio scene 20. The spatial audio scene 20 is a representation of the sound space 10 as if listened to from a particular point of view 42 of a virtual user 40 within the sound space 10.

As illustrated in FIG. 6A, the point of view 42 is determined by an orientation 44 of a virtual user 40 and also possibly a location 46 of the virtual user 40.

Figure 6C:
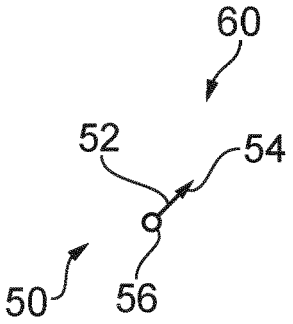
Figure 6D:
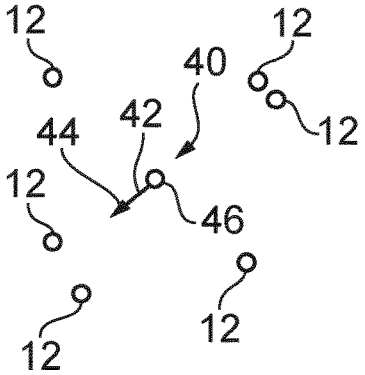
Figure 6E:
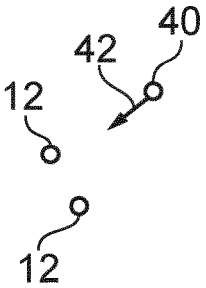

As illustrated in FIG. 6D, the point of view 42 can be changed by changing the orientation 44 and/or location 46 of the virtual user 40. Changing the point of view 42 changes the spatial audio scene 20 as illustrated in FIG. 6E.

In this example, the sound space 10 has six sound sources 12. Two are located to the NE (45°), two are located to the SW (225°), one is located to the NW (315°) and one is located to the SE (135°). In FIG. 6B the point of view is aligned in the NE (45°) direction.

The spatial audio scene 20 comprises, as two distinct sound sources that are spatially separated, the two sound sources 12 located to the NE (45°) in the sound space but does not include the other four sound sources. In FIG. 6E the point of view is aligned in the SW (225°) direction. The spatial audio scene 20 comprises, as two distinct sound sources that are spatially separated, the two sound sources 12 located to the SW (225°) in the sound space but does not include the other four sound sources.

FIG. 6C illustrates how the point of view 42 may be controlled by a user 50. Perspective-mediated means that user actions determine the point of view 42 within the sound space, changing the spatial audio scene 20.

The control of the point of view 42 may be wholly or partially first person perspective-mediated. This is perspective mediated with the additional constraint that the user's real point of view 52 determines the point of view 42 within the sound space 10 of a virtual user 40.

The control of the point of view 42 may be wholly or partially third person perspective-mediated. This is perspective mediated with the additional constraint that the user's real point of view 52 does not determine the point of view within the sound space 10.

Three degrees of freedom (3DoF) describes where the point of view 42 is determined by orientation 44 only (e.g. the three degrees of three-dimensional orientation). In relation to first person perspective-mediated reality, only the orientation 54 of the user 50 in real space 60 determines the point of view 42.

Six degrees of freedom (6DoF) describes where the point of view 42 is a position determined by both orientation 44 (e.g. the three degrees of three-dimensional orientation) and location 46 (e.g. the three degrees of three-dimensional location) of the virtual user 40. In relation to first person perspective-mediated reality, both the orientation 54 of the user 50 in the real space 60 and the location 56 of the user 50 in the real space 60 determine the point of view 42.

The real space (or "physical space") 60 refers to a real environment, which may be three dimensional.

In 3DoF, an orientation 54 of the user 50 in the real space controls a virtual orientation 44 of a virtual user 40. There is a correspondence between the real orientation 54 and the virtual orientation 44 such that a change in the real orientation 54 produces the same change in the virtual orientation 44. The virtual orientation 44 of the virtual user 40 in combination with a virtual field of view may define a spatial audio scene 20. A spatial audio scene 20 is that part of the sound space 10 that is rendered to a user. In 3DoF mediated reality, a change in the real location 56 of the user 50 in real space 60 does not change the virtual location 46 or virtual orientation 44 of the virtual user 40.

In the example of 6DoF, the situation is as described for 3DoF and in addition it is possible to change the rendered spatial audio scene 20 by movement of a real location 56 of the user 50. For example, there may be a mapping between the real location 56 of the user 50 in the real space 60 and the virtual location 46 of the virtual user 40. A change in the real location 56 of the user 50 produces a corresponding change in the virtual location 46 of the virtual user 40. A change in the virtual location 46 of the virtual user 40 changes the rendered spatial audio scene 20.

Figure 6F:
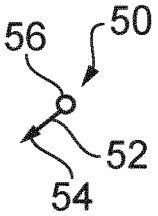

FIGS. 6A, 6B, 6C and FIG. 6D, 6E, 6F illustrate the consequences of a change in real location 52 and real orientation 54 of the user 50 on the rendered spatial audio scene 20. FIGS. 6A, 6B, 6C illustrate the sound space 10, audio scene 20 and real space 60 at a first time. FIGS. 6D, 6E, 6F illustrate the sound space 10, audio scene 20 and real space 60 at a second time after the first time. Between the first time and the second time, the user 60 has changed their point of view 52, which changes the point of view 42 of the virtual user 40, which changes the rendered spatial audio scene 20.

A head-mounted apparatus may be used to track the real orientation 54 and/or real location 56 of the user 50 in the real space 60. The methods 100 may then map a real orientation 54 in three dimensions of the head-mounted apparatus worn by the user 50 to a corresponding orientation 44 in three dimensions of the virtual user 40 and/or map a tracked real location 56 of the user 50 in three dimensions to a corresponding virtual location 46 of the virtual user 40 in corresponding three dimensions of the sound space 10.

Referring to the previously described methods 100, spatial rendering of the first spatial audio scene, at block 102 or 114, may, for example, comprise varying the first spatial audio scene by varying the point of view 42 of the virtual user 40 as described above. Likewise, the spatial rendering of the second spatial audio scene, at block 115, may, for example, comprise varying the second spatial audio scene by varying the point of view 42 of the virtual user 40 as described above. Thus, in response to selection by a user of the rendered audio preview, the method 100 may comprise causing spatial rendering of the second spatial audio scene determined by a point of view of a virtual user associated with the second spatial audio scene.

In some, but not necessarily all, examples, the at least one selected second sound source $\mathbf{12}_u$ is a central focus of the second spatial audio scene when rendered after user selection of the audio preview. This corresponds to the orientation 44 of the virtual user 40 being initially directed towards the at least one selected second sound source $\mathbf{12}_u$. However, as described above, in some examples, the user 60 is able to change their orientation 54 and/or location 56 to change the orientation 44 and/or location 46 of the virtual user 40 and thereby change the rendered spatial audio scene.

As previously described, in some but not necessarily all examples, the methods 100, at block 106, may select the at least one related contextual sound source $\mathbf{12}_c$ from amongst the multiple second sound sources 12, based on the at least one selected second sound source $\mathbf{12}_u$. That is, the selected sound source $\mathbf{12}_u$ and the related contextual sound source $\mathbf{12}_c$ may be sound sources 12 from the same sound space 10 at a particular time.

In some examples, the methods 100 may determine a context based on the at least one selected sound source $\mathbf{12}_u$ and at least one other input and select the at least one related contextual sound source $\mathbf{12}_c$ based on the determined context.

This can be better understood with reference to the following examples.

In one example, the method 100 logically separates the multiple second sound sources 12 into major sound sources and minor sound sources based on spatial and/or audio characteristics. The at least one selected second sound source $\mathbf{12}_u$ is selected by the user from a group comprising the major sound sources and the at least one related contextual sound source $\mathbf{12}_c$ is selected from a group comprising the minor sound sources.

Spatial characteristics that may be used to separate sound sources into major and minor sound sources may include, for example, the location of the sound sources relative to the virtual user 40. For example, those sound sources that are within a threshold distance of the virtual user 40 may be considered to be major sound sources and those that are beyond the threshold distance or do not have a location may be considered to be minor sound sources.

Additionally or alternatively, those sound sources that have a specific location or bearing within the sound space 10 may be major sound sources and those sound sources that relate to ambient sound may be considered to be minor sound sources.

Audio characteristics that may be used to differentiate between the major sound sources and the minor sound sources may, for example, include the loudness (intensity) of the sound sources. For example, those sound sources that are loudest may be considered to be major sound sources and those that are quietest may be considered to be minor sound sources.

Other audio characteristics that may be used may be for example the interactivity of the sound objects, that is whether or not they are time and space correlated one to the other such as persons in a conversation. Those sound objects that are determined to relate to conversation may for example be considered to be major sound sources.

In addition or alternatively those sound sources that are most consistently loud (consistently above a loudness threshold) or most consistent over time (consistently present) may be selected as the major sound sources.

In addition or alternatively those sound sources that relate to dialogue may be selected as the major sound sources and a background music theme can be selected as a minor sound source. Thus, the selection may be from not only spatial (diegetic) sound sources, but also (at least predominantly) non-diegetic sounds such as background sound sources, for example, music and/or narrator voice.

It will therefore be appreciated that the logical division of sound sources into major sound sources and minor sound sources is performed according to defined rules but the definition of those rules may vary.

In other examples, the methods 100 select the at least one related contextual sound source $\mathbf{12}_c$ from amongst the multiple second sound sources 12, based on the at least one selected second sound source $\mathbf{12}_u$ and upon metadata provided as an original part of the second spatial audio content by a creator of the second spatial audio content. In this way, each audio scene can be manually tagged using annotations from the content creator, with metadata that identifies one or more contextual sources for the spatial audio scene.

In addition or alternatively, the methods 100 may select the at least one related contextual sound source $\mathbf{12}_c$, from amongst the multiple second sound sources 12, based on at least the one selected sound source $\mathbf{12}_u$ and upon a metric dependent upon the loudness of the multiple second sound sources 12. The loudness may, for example, be the loudness as perceived at the location of the selected sound source $\mathbf{12}_u$. For example, the loudest second sound source may be selected or the most consistently loud sound source may be selected or the most consistent sound source may be selected or the closest second sound source 12 may be selected.

Alternatively or additionally, the methods 100 may be configured to select the at least one related contextual sound source $\mathbf{12}_c$, from amongst the multiple second sound sources 12, based on at least one selected second sound source $\mathbf{12}_u$ and upon a metric dependent upon one or more defined ontologies between the multiple second sound sources 12. An ontology is defined by the properties of the sound sources 12 and the relationship between those properties. For example, the related contextual sound source $\mathbf{12}_c$ may be selected because it uses a musical instrument that is the same or similar to the musical instrument used in the selected second sound source $\mathbf{12}_u$, or because it uses a musical instrument that is defined as being harmonious with the musical instrument used in the selected second sound source $\mathbf{12}_u$.

Alternatively or additionally, the methods 100 may be configured to select the at least one related contextual sound source $\mathbf{12}_c$ from amongst a sub-set of the multiple second sound sources 12, based on the at least one selected second sound source $12_u$ where the sub-set of the multiple second sound sources comprises the sound sources that are the same irrespective of orientation 54 of the user 50 and does not comprise sound sources 12 that vary with orientation 54 of the user 50.

In this example, the sub-set of the multiple second sound sources 12 comprises non-diegetic sound sources and does not comprise sound sources labelled as diegetic. The sound sources of the sub-set are fixed in space. The sound sources of the sub-set may, for example, represent ambient or background noise.

In another example, the related contextual sound source $12_c$ may be a sound source that has a high correlation over time with the selected sound source $12_u$. Correlation here means some sort of similar temporal occurrence but not necessarily similar audio content, in fact it is desirable to have dissimilar audio content. For example, the at least one related contextual sound source $12_c$ may be a sound source that occurs simultaneously with the selected sound source $12_u$. For example, the selected at least one related contextual sound source $12_c$ may occur whenever the selected sound source $12_u$ occurs. As a further condition, the at least one related contextual sound source $12_c$ may not occur whenever the selected sound source $12_u$ does not occur.

Alternatively or additionally, the methods 100 may be configured to select the at least one related contextual sound source $12_c$ from amongst a sub-set of the multiple second sound sources 12, based on at least one selected second sound source $12_u$, wherein the sub-set of the multiple second sound sources comprises sound sources dependent upon the virtual user 40. For example, the selected at least one related contextual sound source $12_c$ may be the closest or one of the closest sound sources to the location 46 of the virtual user 40. For example, the at least one related contextual sound source $12_c$ or the sub-set of multiple second sound sources may have a defined ontology with the user 60. For example, the at least one related contextual sound source $12_c$ and the sub-set of the multiple second sound sources may have properties that they share in common with the selected sound source $12_u$ based on user preferences. For example, the at least one related contextual sound source $12_c$ and the selected second sound source $12_u$ may be sound sources that the user has previously indicated that they like or that the method 100 determines there is a sufficient probability that the user will like based on a machine learning algorithm.

Figure 7:
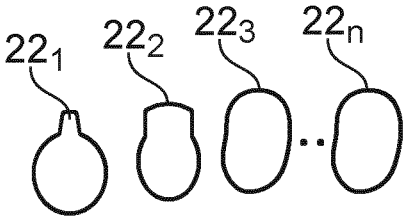
FIG. 7 shows an example embodiment of the subject matter described herein.

FIG. 7 illustrates an example of a method 100 in which multiple previews $22_1$, $22_2$, $22_3$ . . . $22_n$ are simultaneously rendered. The method 100 causes rendering of multiple audio previews 22, representing different respective spatial audio content. Selected by a user of a particular audio preview 22 cause spatial rendering of the spatial audio scene associated with that audio preview defined by the associated respective spatial audio content. The spatial audio scene comprises multiple sound sources, defined by the associated respective spatial audio content.

Each audio preview comprises an associated mix of sound sources including at least one user-selected sound source $12_u$ and at least one context-selected sound source $12_c$, dependent upon the at least one selected second sound source $12_u$, but not including all of the respective multiple sound sources of the spatial audio scene associated with that audio preview.

The method 100 then enables the user to browse the multiple audio previews 22 without selecting an audio preview and enables the user to browse the multiple audio previews 22 to a desired audio preview 22 and to select the desired audio preview 22. In response to the selection by the user of the rendered audio preview, the method 100 causes spatial rendering of the spatial audio scene associated with that selected audio preview.

In some examples, each of the multiple audio previews 22 may be based upon a different selected sound source $12_u$. These may, for example, be generated as a consequence of a keyword search or similar. In other examples, each of the multiple audio previews 22 has in common the same or similar user-selected sound source $12_u$ but is based upon different context-selected sound sources $12_c$.

Figure 8A:
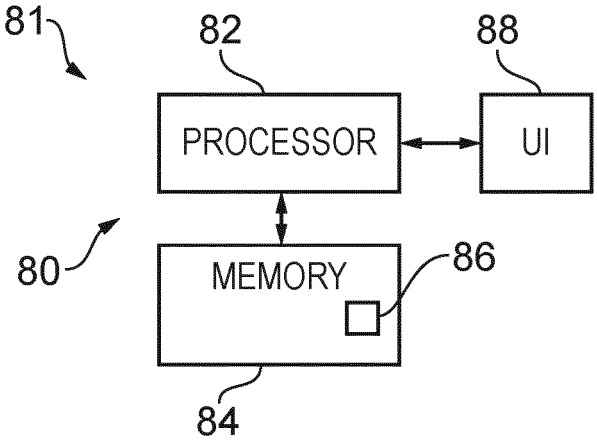
FIG. 8A shows another example embodiment of the subject matter described herein

FIG. 8A illustrates an example of a controller 80. Implementation of a controller 80 may be as controller circuitry. The controller 80 may be implemented in hardware alone, have certain aspects in software including firmware alone or can be a combination of hardware and software (including firmware).

As illustrated in FIG. 8A the controller 80 may be implemented using instructions that enable hardware functionality, for example, by using executable instructions of a computer program 86 in a general-purpose or special-purpose processor 82 that may be stored on a computer readable storage medium (disk, memory etc) to be executed by such a processor 82.

The processor 82 is configured to read from and write to the memory 84. The processor 82 may also comprise an output interface via which data and/or commands are output by the processor 82 and an input interface via which data and/or commands are input to the processor 82.

The memory 84 stores a computer program 86 comprising computer program instructions (computer program code) that controls the operation of the apparatus 81 when loaded into the processor 82. The computer program instructions, of the computer program 86, provide the logic and routines that enables the apparatus to perform the methods 100, for example as illustrated in FIGS. 1 to 3. The processor 82 by reading the memory 84 is able to load and execute the computer program 86.

The apparatus 81 therefore comprises:

at least one processor 82; and at least one memory 84 including computer program code the at least one memory 84 and the computer program code configured to, with the at least one processor 82, cause the apparatus 81 at least to perform:

in response to user input, selecting at least one sound source of a spatial audio scene defined by spatial audio content and comprising multiple sound sources;

selecting at least one related contextual sound source $12_c$ based on the at least one selected sound source $12_u$;

causing rendering of an audio preview, representing the spatial audio content, that can be selected by a user, wherein the audio preview comprises a mix of sound sources including at least the selected sound source $12_u$ and the at least one related contextual sound source $12_c$ but not all of the multiple sound sources of the spatial audio scene, wherein selection of the audio preview causes an operation on at least the selected sound source $12_u$ and the at least one related contextual sound source $12_c$.

Figure 8B:
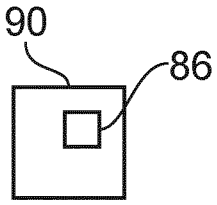
FIG. 8B shows an example embodiment of the subject matter described herein.

As illustrated in FIG. 8B, the computer program 86 may arrive at the apparatus 81 via any suitable delivery mechanism 90. The delivery mechanism 90 may be, for example, a machine readable medium, a computer-readable medium, a non-transitory computer-readable storage medium, a computer program product, a memory device, a record medium such as a Compact Disc Read-Only Memory (CD-ROM) or a Digital Versatile Disc (DVD) or a solid state memory, an article of manufacture that comprises or tangibly embodies the computer program 86. The delivery mechanism may be a signal configured to reliably transfer the computer program 86. The apparatus 81 may propagate or transmit the computer program 86 as a computer data signal.

Computer program instructions for causing an apparatus to perform at least the following or for performing at least the following:

causing, in response to user input, selection of at least one sound source of a spatial audio scene defined by spatial audio content and comprising multiple sound sources; selecting at least one related contextual sound source $\mathbf{12}_c$ based on the at least one selected sound source $\mathbf{12}_u$;

causing rendering of an audio preview, representing the spatial audio content, that can be selected by a user, wherein the audio preview comprises a mix of sound sources including at least the selected sound source $\mathbf{12}_u$ and the at least one related contextual sound source $\mathbf{12}_c$ but not all of the multiple sound sources of the spatial audio scene, wherein selection of the audio preview causes an operation on at least the selected sound source $\mathbf{12}_u$ and the at least one related contextual sound source $\mathbf{12}_c$.

The computer program instructions may be comprised in a computer program, a non-transitory computer readable medium, a computer program product, a machine readable medium. In some but not necessarily all examples, the computer program instructions may be distributed over more than one computer program.

Although the memory 84 is illustrated as a single component/circuitry it may be implemented as one or more separate components/circuitry some or all of which may be integrated/removable and/or may provide permanent/semi-permanent/dynamic/cached storage.

Although the processor 82 is illustrated as a single component/circuitry it may be implemented as one or more separate components/circuitry some or all of which may be integrated/removable. The processor 82 may be a single core or multi-core processor.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' may refer to one or more or all of the following:

(a) hardware-only circuitry implementations (such as implementations in only analog and/or digital circuitry) and (b) combinations of hardware circuits and software, such as (as applicable):

(i) a combination of analog and/or digital hardware circuit(s) with software/firmware and (ii) any portions of hardware processor(s) with software (including digital signal processor(s)), software, and memory(ies) that work together to cause an apparatus, such as a mobile phone or server, to perform various functions and (c) hardware circuit(s) and or processor(s), such as a microprocessor(s) or a portion of a microprocessor(s), that requires software (e.g. firmware) for operation, but the software may not be present when it is not needed for operation.

This definition of circuitry applies to all uses of this term in this application, including in any claims. As a further example, as used in this application, the term circuitry also covers an implementation of merely a hardware circuit or processor and its (or their) accompanying software and/or firmware. The term circuitry also covers, for example and if applicable to the particular claim element, a baseband integrated circuit for a mobile device or a similar integrated circuit in a server, a cellular network device, or other computing or network device.

The blocks illustrated in the FIGS. 1 to 3 may represent steps in a method and/or sections of code in the computer program 86. The illustration of a particular order to the blocks does not necessarily imply that there is a required or preferred order for the blocks and the order and arrangement of the block may be varied. Furthermore, it may be possible for some blocks to be omitted.

Reference will now be made to various different embodiments.

In a first embodiment, when a user selects a sound source rendered in a spatial audio scene, this acts as a trigger for generating an audio preview of that sound source $\mathbf{12}_u$ for that scene at that time (and for its related contextual sound source $\mathbf{12}_c$). The audio preview 22 can be used as a way to "filter" the currently rendered spatial audio scene 20 to focus on a particular selected sound source $\mathbf{12}_u$ (and its associated contextual sound source $\mathbf{12}_c$).

Referring back to the example of FIG. 3, at block 102, the method 100 comprises spatial rendering of a first spatial audio scene 20 comprising multiple first sound sources 12 defined by first spatial audio content. This is rendered before the user input at block 104.

Then at block 104, the method 100 comprises selecting at least one first sound source of the first spatial audio scene, comprising multiple first sound sources, defined by the first spatial audio content. This selection is performed by the user. The user input is selection of the at least one first sound source rendered in the first spatial audio scene.

Then, at block 106, the method 100 comprises selecting at least one related contextual sound source $\mathbf{12}_c$ based on at least one selected first sound source $\mathbf{12}_u$. This step may be performed automatically without user input.

Then, at block 108, the method 100 comprises causing rendering of an audio preview, representing the first spatial audio content, that can be selected by a user. The audio preview comprises a mix of sound sources including at least the at least one selected first sound source $\mathbf{12}_u$ and the at least one related contextual sound source $\mathbf{12}_c$ but not all of the multiple first sound sources 12 of the first spatial audio scene 20. Selection of the audio preview causes an operation on at least the selected first sound source $\mathbf{12}_u$ and the at least one related contextual sound source $\mathbf{12}_c$.

In some, but not necessarily all, examples, the operation on the at least one selected first sound source $\mathbf{12}_u$ and the at least one related contextual sound source $\mathbf{12}_c$ is causing spatial rendering of the first spatial audio scene, comprising the multiple first sound sources including the selected first sound source $\mathbf{12}_u$ and the at least one related contextual sound source $\mathbf{12}_c$. The spatial audio scene that is rendered as a consequence of user selection of the audio preview may therefore be the same or similar to the spatial audio scene rendered before the user input at block 104.

In other embodiments, the user selection of the rendered audio preview causes rendering of a new spatial audio scene.

For example, referring to FIG. 3, the block 102 is optional. If it is present, it comprises spatial rendering of a first spatial audio scene, comprising multiple first sound sources, defined by first spatial audio content before the user input at block 104.

At block 104, the method 100 comprises selecting at least one second sound source $\mathbf{12}_u$ of a second spatial audio scene 20, comprising multiple second sound sources, defined by second spatial audio content.

The at least one second sound source, in this example, is not one of the first sound sources.

At block 106, the method 100 comprises selecting at least one related contextual sound source $\mathbf{12}_c$ based on the at least one selected second sound source $\mathbf{12}_u$. This may be performed automatically without user input. The at least one related contextual sound source $\mathbf{12}_c$ can be but is not necessarily one of the multiple second sound sources defining the second spatial audio scene 20.

At block 108, the method 100 comprises causing rendering of an audio preview, representing the second spatial audio content, that can be selected by a user. The audio preview comprises a mix of sound sources including at least the at least one selected second sound source $\mathbf{12}_u$ and the at least one related contextual sound source $\mathbf{12}_c$ but not all of the multiple second sound sources 12 of the second spatial audio scene 20. User selection of the audio preview causes an operation on at least the selected second sound source $\mathbf{12}_u$ and the at least one related contextual sound source $\mathbf{12}_c$.

In some but not necessarily all examples, the operation on at least the selected second sound source $\mathbf{12}_u$ and the at least one related contextual sound source $\mathbf{12}_c$ is causing spatial rendering of the second spatial audio scene 20, comprising multiple second sound sources 12 including the selected second sound source $\mathbf{12}_u$ and the at least one related contextual sound source $\mathbf{12}_c$.

In different versions of this embodiment, the selection of the second sound source $\mathbf{12}_u$ at block 104 may occur in different ways. For example, the user input can specify a search.

In one example, while rendering the first spatial audio scene, the user input at block 104 is selection of at least one first sound source rendered in the first spatial audio scene. That is, there is user selection of a first sound source. There is then automatic selection of a second sound source that is related to the user-selected first sound source. The second sound source may be related to the user-selected first sound source in one or more different ways. For example, they may relate to the same identity of sound source at a different time or in a different sound space. For example, they may relate to similar sound sources at a different time, a different orientation, a different location or a different sound space. The generated audio preview therefore generates a preview for the second sound source $\mathbf{12}_u$ that is related to the user-selected first sound source.

In other examples, the user input may specify a search by using keywords or some other data input. The selected second sound source $\mathbf{12}_u$, selected at block 104, is then selected based upon the specified search criteria. In some examples, where multiple search results are returned, then multiple audio previews 22 may be produced as illustrated in FIG. 7.

Where a structural feature has been described, it may be replaced by means for performing one or more of the functions of the structural feature whether that function or those functions are explicitly or implicitly described.

Where a function or process has been described, it may be performed by the apparatus 81 or any suitable means for performing the function whether those means are explicitly or implicitly described.

In some but not necessarily all examples, the apparatus 81 is configured to communicate data from the apparatus 81 with or without local storage of the data in a memory 84 at the apparatus 81 and with or without local processing of the data by circuitry or processors at the apparatus 81.

The data may be stored in processed or unprocessed format remotely at one or more devices. The data may be stored in the Cloud.

The data may be processed remotely at one or more devices. The data may be partially processed locally and partially processed remotely at one or more devices.

The data may be communicated to the remote devices wirelessly via short range radio communications such as Wi-Fi or Bluetooth, for example, or over long range cellular radio links. The apparatus may comprise a communications interface such as, for example, a radio transceiver for communication of data.

The apparatus 81 may be part of the Internet of Things forming part of a larger, distributed network.

The processing of the data, whether local or remote, may be for the purpose of health monitoring, data aggregation, patient monitoring, vital signs monitoring or other purposes.

The processing of the data, whether local or remote, may involve artificial intelligence or machine learning algorithms. The data may, for example, be used as learning input to train a machine learning network or may be used as a query input to a machine learning network, which provides a response. The machine learning network may for example use linear regression, logistic regression, vector support machines or an acyclic machine learning network such as a single or multi hidden layer neural network.

The processing of the data, whether local or remote, may produce an output. The output may be communicated to the apparatus 81 where it may produce an output sensible to the subject such as an audio output, visual output or haptic output.

The systems, apparatus, methods and computer programs may use machine learning which can include statistical learning. Machine learning is a field of computer science that gives computers the ability to learn without being explicitly programmed. The computer learns from experience E with respect to some class of tasks T and performance measure P if its performance at tasks in T, as measured by P, improves with experience E. The computer can often learn from prior training data to make predictions on future data. Machine learning includes wholly or partially supervised learning and wholly or partially unsupervised learning. It may enable discrete outputs (for example classification, clustering) and continuous outputs (for example regression). Machine learning may for example be implemented using different approaches such as cost function minimization, artificial neural networks, support vector machines and Bayesian networks for example. Cost function minimization may, for example, be used in linear and polynomial regression and K-means clustering. Artificial neural networks, for example with one or more hidden layers, model complex relationship between input vectors and output vectors. Support vector machines may be used for supervised learning. A Bayesian network is a directed acyclic graph that represents the conditional independence of a number of random variables.

The above described examples find application as enabling components of:

automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one." or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning. That is any reference to X comprising a/the Y indicates that X may comprise only one Y or may comprise more than one Y uncles the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature (or combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

We claim:

1. An apparatus comprising:

at least one processor; and at least one memory including computer program code, the at least one memory and the computer program code configured to, with the at least one processor, cause the apparatus to perform at least the following:

based on a user input, select at least one sound source of a spatial audio scene, comprising multiple sound sources, the spatial audio scene being defined by spatial audio content;

select at least one related contextual sound source based on the at least one selected sound source;

generate a mix of sound sources including at least the at least one selected sound source and the at least one related contextual sound source but not all of the multiple sound sources of the spatial audio scene; and cause rendering of an audio preview, representing the spatial audio content, that can be selected by a user, wherein the audio preview comprises the generated mix, and wherein selection of the audio preview causes spatial rendering of the spatial audio scene comprising the at least one selected sound source.

2. The apparatus as claimed in claim 1, wherein the spatial audio scene comprises multiple sound sources including the selected sound source and the at least one related contextual sound source, the spatial audio scene being defined by spatial audio content.

3. The apparatus as claimed in claim 1, wherein the apparatus is further caused to, before the user input:

spatial render of a first spatial audio scene, comprising multiple first sound sources, defined by first spatial audio content, wherein the user input is selection of at least one first sound source rendered in the first spatial audio scene.

4. The apparatus as claimed in claim 3, wherein selecting at least one sound source of a spatial audio scene, comprising multiple sound sources, defined by spatial audio content comprises selecting at least one first sound source of the first spatial audio scene, comprising multiple first sound sources, defined by first spatial audio content, wherein selecting at least one related contextual sound source based on the at least one selected sound source comprises selecting at least one related contextual sound source based on the at least one selected first sound source, wherein causing rendering of an audio preview, representing the spatial audio content, that can be selected by a user comprises causing rendering of an audio preview, representing the first spatial audio content, that can be selected by a user, wherein the audio preview comprises a mix of sound sources including at least the at least one selected first sound source and the at least one related contextual sound source but not all of the multiple first sound sources of the first spatial audio scene, wherein selection of the audio preview causes spatial rendering of the first spatial audio scene comprising at least the selected first sound source and the at least one related first contextual sound source.

5. The apparatus as claimed in claim 1, wherein the user input is specifying a search.

6. The apparatus as claimed in claim 1, wherein selecting at least one sound source of a spatial audio scene, comprising multiple sound sources, defined by spatial audio content comprises selecting at least one second sound source of a second new spatial audio scene, comprising multiple second sound sources, defined by second spatial audio content, wherein selecting at least one related contextual sound source based on the at least one selected sound source comprises selecting at least one related contextual sound source based on the at least one selected second sound source, wherein causing rendering of an audio preview, representing the spatial audio content, that can be selected by a user comprises causing rendering of an audio preview, representing the second spatial audio content, that can be selected by a user, wherein the audio preview comprises a mix of sound sources including at least the at least one selected second sound source and the at least one related contextual sound source but not all of the multiple second sound sources of the second spatial audio scene, wherein selection of the audio preview causes spatial rendering of the second new spatial audio scene comprising at least the selected second sound source.

7. The apparatus as claimed in claim 1, wherein the apparatus is further caused to:

based on a selection by a user of the rendered audio preview, represent the spatial audio content, cause spatial rendering of the spatial audio scene defined by the spatial audio content including rendering of the multiple sound sources;

determine a virtual user position comprising a location and an orientation, associated with the spatial audio scene; and enable a user to change the rendered spatial audio scene from the spatial audio scene by changing the position of the virtual user, the position of the virtual user being dependent on a changing orientation of the user or a changing a location and orientation of the user.

8. The apparatus as claimed in claim 1, wherein the apparatus is further caused to:

select the at least one related contextual sound source, from amongst the multiple sound sources, based on the at least one selected sound source.

9. The apparatus as claimed in claim 1, wherein the apparatus is further caused to:

separate the multiple sound sources into major sound sources and minor sound sources based on spatial and/or audio characteristics, wherein the at least one selected sound source is selected from a group comprising the major sound sources and wherein the at least one related contextual sound source is selected from a group comprising the minor sound sources.

10. The apparatus as claimed in claim 1, wherein the apparatus is further caused to:

select the at least one related contextual sound source, from amongst the multiple sound sources, based on the at least one selected sound source and upon at least one of:

metadata provided as an original part of the spatial audio content by a creator of the spatial audio content;

a metric dependent upon loudness of the multiple sound sources; or a metric dependent upon one or more defined ontologies between the multiple sound sources.

11. The apparatus as claimed in claim 1, wherein the apparatus is further caused to:

select the at least one related contextual sound source, from amongst a sub-set of the multiple sound sources, based on the at least one selected sound source, wherein the sub-set of the multiple sound sources comprises sound sources that are the same irrespective of orientation of the user and does not comprise sound sources that vary with orientation of the user, or select the at least one related contextual sound source, from amongst a sub-set of the multiple sound sources, based on the at least one selected sound source, wherein the sub-set of the multiple sound sources comprises sound sources dependent upon the user.

12. The apparatus as claimed in claim 1, wherein the apparatus is further caused to:

cause rendering of multiple audio previews, representing different respective spatial audio content, that can be selected by a user to cause spatial rendering of different respective spatial audio scenes, comprising different respective multiple sound sources, defined by the different respective spatial audio content, wherein an audio preview comprises a mix of sound sources including at least one user-selected sound source and at least one context-selected sound source, dependent upon the at least one selected sound source, but not including all of the respective multiple sound sources of the respective spatial audio scene;

enable the user to browse the multiple audio previews without selecting an audio preview;

enable the user to browse the multiple audio previews to a desired audio preview and to select the desired audio preview; and based on a selection by a user of a rendered audio preview, cause spatial rendering of the spatial audio scene defined by the selected spatial audio content including rendering of the multiple sound sources comprised in the selected spatial audio content.

13. A method comprising:

based on a user input, selecting at least one sound source of a spatial audio scene defined by spatial audio content and comprising multiple sound sources;

selecting at least one related contextual sound source based on the at least one selected sound source;

generating a mix of sound sources including at least the at least one selected sound source and the at least one related contextual sound source but not all of the multiple sound sources of the spatial audio scene; and causing rendering of an audio preview, representing the spatial audio content, that can be selected by a user, wherein the audio preview comprises the generated mix, wherein selection of the audio preview causes spatial rendering of the spatial audio scene comprising the at least one selected sound source.

14. A method as claimed in claim 13, wherein selecting at least one related contextual sound source comprises selecting the at least one related contextual sound source, from amongst the multiple sound sources, based on the at least one selected sound source and upon at least one of:

metadata provided as an original part of the spatial audio content by a creator of the spatial audio content;

a metric dependent upon loudness of the multiple sound sources; or a metric dependent upon one or more defined ontologies between the multiple sound sources.

15. The method as claimed in claim 13, wherein the spatial audio scene comprises multiple sound sources including the at least one selected sound source and the at least one related contextual sound source, the spatial audio scene being defined by spatial audio content.

16. The method as claimed in claim 13, further comprising, before the user input:

spatial rendering of a first spatial audio scene, comprising multiple first sound sources, defined by first spatial audio content, wherein the user input is selection of at least one first sound source rendered in the first spatial audio scene.

17. The method as claimed in claim 16, wherein selecting at least one sound source of a spatial audio scene, comprising multiple sound sources, defined by spatial audio content comprises selecting at least one first sound source of the first spatial audio scene, comprising multiple first sound sources, defined by first spatial audio content, wherein selecting at least one related contextual sound source based on the at least one selected sound source comprises selecting at least one related contextual sound source based on the at least one selected first sound source, wherein causing rendering of an audio preview, representing the spatial audio content, that can be selected by a user comprises causing rendering of an audio preview, representing the first spatial audio content, that can be selected by a user, wherein the audio preview comprises a mix of sound sources including at least the at least one selected first sound source and the at least one related contextual sound source but not all of the multiple first sound sources of the first spatial audio scene, wherein selection of the audio preview causes spatial rendering of at least the selected first sound source and the at least one related first contextual sound source.

18. The method as claimed in claim 13, wherein the user input is specifying a search.

19. The method as claimed in claim 13, wherein selecting at least one sound source of a spatial audio scene, comprising multiple sound sources, defined by spatial audio content comprises selecting at least one second sound source of a second new spatial audio scene, comprising multiple second sound sources, defined by second spatial audio content, wherein selecting at least one related contextual sound source based on the at least one selected sound source comprises selecting at least one related contextual sound source based on the at least one selected second sound source, wherein causing rendering of an audio preview, representing the spatial audio content, that can be selected by a user comprises causing rendering of an audio preview, representing the second spatial audio content, that can be selected by a user, wherein the audio preview comprises a mix of sound sources including at least the at least one selected second sound source and the at least one related contextual sound source but not all of the multiple second sound sources of the second spatial audio scene, wherein selection of the audio preview causes spatial rendering of at least the selected second sound source.

20. A non-transitory computer readable medium comprising program instructions stored thereon for performing at least the following:

based on a user input, selecting at least one sound source of a spatial audio scene defined by spatial audio content and comprising multiple sound sources;

selecting at least one related contextual sound source based on the at least one selected sound source;

generating a mix of sound sources including at least the at least one selected sound source and the at least one related contextual sound source but not all of the multiple sound sources of the spatial audio scene; and causing rendering of an audio preview, representing the spatial audio content, that can be selected by a user, wherein the audio preview comprises the generated mix, wherein selection of the audio preview causes spatial rendering of the spatial audio scene comprising the at least one selected sound source.

* * * * *